United States Patent [19]

Morris et al.

[11] Patent Number: 5,010,328

[45] Date of Patent: Apr. 23, 1991

[54] DISPLAY DEVICE

[75] Inventors: Christopher J. Morris, Feltham; Ian Coulson, Maidenhead; Paul W. H. Surguy, Uxbridge, all of England

[73] Assignee: Thorn EMI plc, London, England

[21] Appl. No.: 220,316

[22] Filed: Jul. 18, 1988

[30] Foreign Application Priority Data

Jul. 21, 1987 [GB] United Kingdom ..... 8717172
Aug. 3, 1987 [GB] United Kingdom ..... 8718351

[51] Int. Cl.[5] ..... G09G 3/00

[52] U.S. Cl. ..... 340/784; 340/805; 350/332; 350/333

[58] Field of Search ..... 340/784, 789, 802, 805; 350/332, 333, 350 S

[56] References Cited

U.S. PATENT DOCUMENTS 4,638,310 1/1987 Ayliffe ..... 340/784
4,705,345 11/1987 Ayliffe et al. ..... 340/784
4,728,947 3/1988 Ayliffe et al. ..... 340/784

FOREIGN PATENT DOCUMENTS 2173335 10/1986 United Kingdom .
2173336 10/1986 United Kingdom .

*Primary Examiner*—Alvin E. Oberley
*Assistant Examiner*—Richard Hjerpe
*Attorney, Agent, or Firm*—Fleit, Jacobson, Cohn, Price, Holman & Stern

[57] ABSTRACT

A method is provided for addressing a matrix-array type liquid crystal cell with a ferroelectric liquid crystal layer having a plurality of pixels defined by areas of overlap between members of a first set of electrodes on one side of the liquid crystal layer and members of a second set of electrodes on the other side of the liquid crystal layer, each of the pixels having a first and a second optically distinguishable state and a response time for switching between the two states which depends on the potential difference across the liquid crystal layer. The method includes the step of applying a switching pixel waveform to a selected pixel to switch it between the two states. The switching pixel waveform is charge-balanced and comprises a first pulse having a sufficient pulse width and pulse height magnitude to switch the selected pixel and a second pulse contributing to charge-balancing. The second pulse has a pulse height magnitude greater than the sufficient pulse height magnitude of the first pulse and a pulse width which is insufficient to switch the selected pixel.

18 Claims, 11 Drawing Sheets

FIG. 12(a)
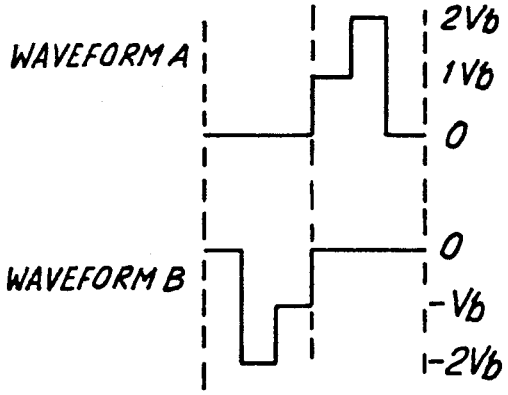
FIG. 12(b)
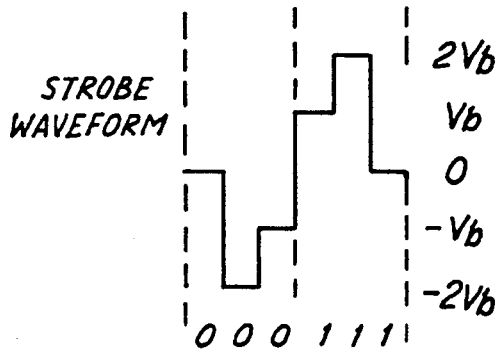
FIG. 12(c)
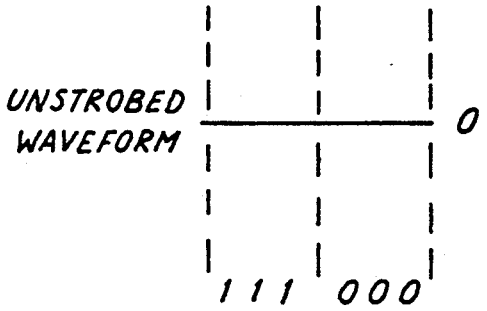
FIG. 12(d)
FIG. 12(e)
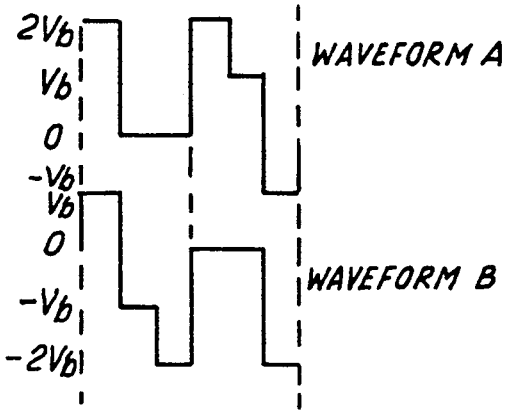
FIG. 12(f)
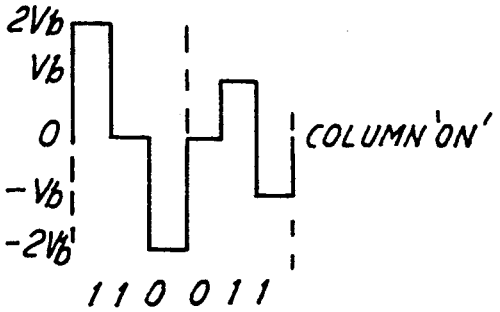
FIG. 12(g)
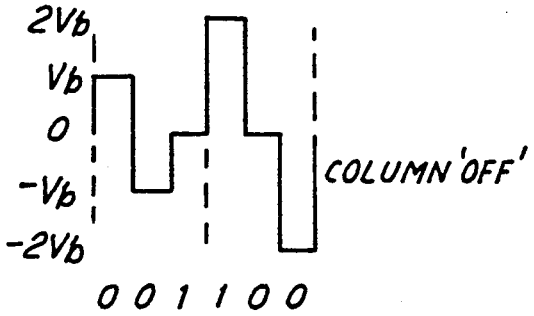
FIG. 12(h)

DISPLAY DEVICE

The present invention relates to a liquid crystal display device.

The present invention concerns a display device comprising a matrix of selectively settable ferroelectric liquid crystal elements and, in particular, a method of addressing such a display device. In the invention, there is multiplexing of the matrix using the width of a pulse and/or the height of a pulse.

A liquid crystal material consists of long thin polar molecules and so can preserve a high degree of long range orientational ordering of the molecules in a liquid condition. Such materials are anisotropic with properties, such as dielectric constant, characterised by two constants, one in the direction of the long molecular axis and one perpendicular to it. The anisotropic nature of the dielectric constant enables the molecules to be aligned in an electric field, the molecules tending to be orientated in the direction giving the minimum electrostatic free energy.

Some liquid crystal materials also exhibit ferroelectric properties i.e. thev have a permanent dipole moment which is perpendicular to the long molecular axis. When the liquid crystal material is placed between two glass plates whose surfaces have been treated to align the molecules, then the molecules will have two possible states depending on the direction of the permanent dipole moment. These states are bistable. By applying an electric field of the correct amplitude and polarity, it is possible to switch the molecules between the two states.

In a matrix-type display device comprising a ferroelectric liquid crystal layer, the pixels of the matrix are defined by areas of overlap between members of a first set of electrodes on one side of the liquid crystal layer and members of a second set of electrodes on the other side of the liquid crystal layer. An electric field is applied across the molecules of a pixel by the generation of voltages at the member of the first set of electrodes and the member of the second set of electrodes that define the pixel.

The individual electrodes can be either in electrical contact with or insulated from the liquid crystal layer. In the former case, there is a risk of electrolytic degradation of the liquid crystal if there is a net flow of direct current through the layer. In the latter case, there is the risk of a cumulative build-up of charge at the interface between the liquid crystal and the insulation. Both these risks can be reduced by ensuring that the voltage waveforms applied to the individual electrodes over time are charge-balanced, i.e. have a zero d.c. content, at least in the long term.

GB 2173335A (STC) discloses a method of addressing a matrix addressed ferroelectric liquid crystal cell in which a switching pulse of height $(V_5+V_d)$ and width $t_s$ is charge balanced by three pulses of the opposite polarity—one of height $-(V_5-V_d)$ and width $t_5$ and two of height $mV_d$ and width $t_s/m$ where m is a factor greater than unity. The document suggests that such a method can be used with a display device in which the liquid crystal material can tolerate a reverse polarity of the same duration but only 75% of the amplitude of a pulse that is just sufficient to effect switching. However, the minimum line address time (i.e. the minimum time necessary to generate a voltage waveform including a switching pulse and charge-balancing pulses) for the method is $2t_5(1+1/m)$.

The inventors have noted that the width of a pulse has more effect on the tendency of the pixel to switch than the pulse height. The present invention makes use of this discovery.

A reason for this is that, as outlined above, an electric field has two effects on ferroelectric liquid crystal molecules. One is to stabilise them into the nearest preferred state by acting on the dielectric anisotropy. The applied couple due to this effect is proportional to the square of the voltage. The other effect of the field is to act on the permanent dipole. The couple applied due to this effect is proportional to the voltage. The net effect is a parabolic voltage to 'switching force' characteristic. Thus a long low voltage pulse can have much greater effect than a short high voltage pulse of the same area.

According to the present invention, there is provided a method of addressing a matrix-array type liquid crystal cell with a ferroelectric liquid crystal layer having a plurality of pixels defined by areas of overlap between members of a first set of electrodes on one side of the liquid crystal layer and members of a second set of electrodes on the other side of the liquid crystal layer, each of said pixels having a first and a second optically distinguishable state, and having a response time for switching between said first and said second states which depends on the potential difference across the liquid crystal layer, the method including the step of applying a switching pixel waveform to a selected pixel to switch said selected pixel between said first and second states wherein said switching pixel waveform is charge-balanced and comprises a first pulse having a sufficient pulse width and pulse height magnitude to switch said selected pixel and a second pulse contributing to charge-balancing, said second pulse having a pulse height magnitude greater than the sufficient pulse height magnitude of said first pulse and a pulse width which is insufficient to switch said selected pixel.

The first pulse, i.e. the switching pulse, is charge-balanced. This charge-balancing is, in part, by a second pulse having a pulse height magnitude greater than that of the first pulse. The pulse width of the second pulse is accordingly less than the pulse width of the first pulse and so the minimum address time of the method can be less than twice the pulse width of the first pulse. This is a reduction in minimun line address time compared with prior art charge-balanced switching waveforms. In effect, whether or not a pulse is a switching pulse, is, in the present invention, being determined by its pulse width.

With regard to the terminology of the present specification, it is to be noted that the term 'slot' can have one of two meanings i.e. (1) the minimum time that a liquid crystal material takes to switch from a first state to a second state for a given pulse height; (2) the time for which a waveform is at a (given) constant voltage, i.e. the pulse width of a pulse of a given pulse height.

As meaning (2) is more common in the art, this will be the meaning intended in the present specification unless otherwise indicated. Also unless otherwise indicated the term used in the present specification for meaning (1) will be 'response time, $t_5$'. Embodiments of the invention will now be described, by way of example only, and with reference to the accompanying drawings in which.

Figure 1:
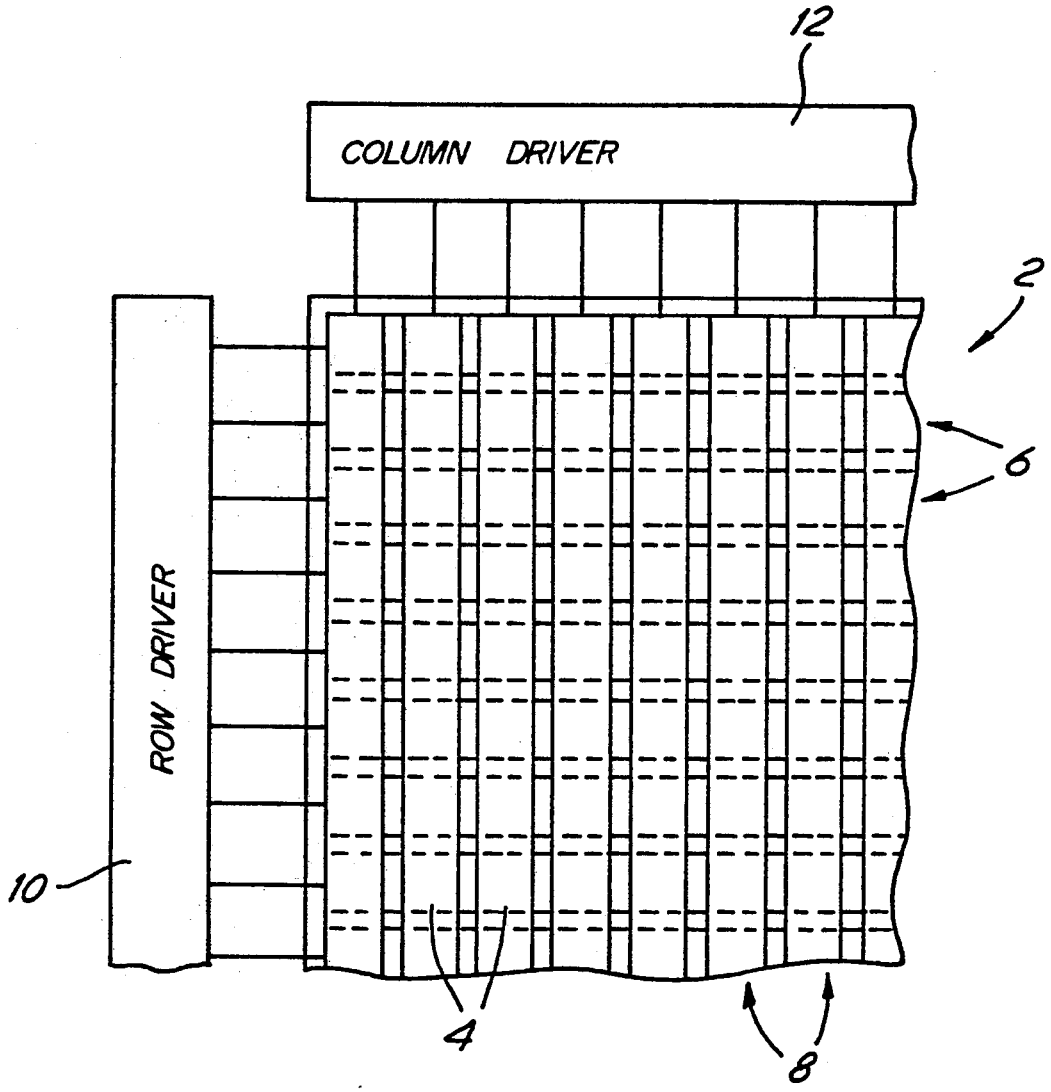
FIG. 1 shows, schematically, a liquid crystal display device which can be driven by the method of the present invention.
Figure 3:
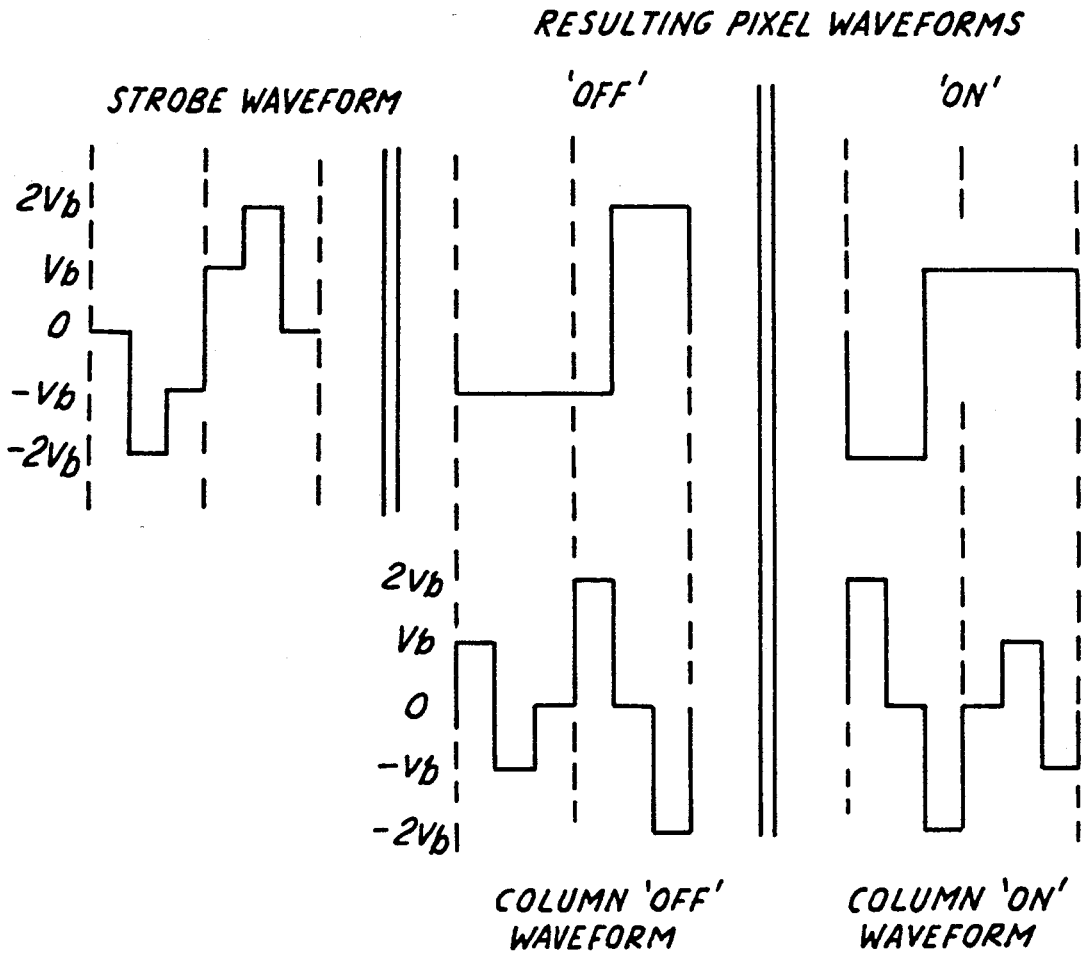

FIGS. 12*a* to 12*h* shows waveforms used in a drive circuit to implement the waveform arrangement of FIG. 3. FIG. 1 shows, schematically, part of a matrix-array type liquid crystal cell 2 with a layer formed of a ferroelectric liquid crystal material such as a biphenyl ester sold under the trade name BDH SCE3 and having a thickness in the range of from 1.4 μm to 2.0 μm. The pixels 4 of the matrix are defined by areas of overlap between members of a first set of row electrodes 6 on one side of the liquid crystal layer and members of a second set of column electrodes 8 on the other side of the liquid crystal layer. For each pixel, the electric field thereacross determines the state and hence alignment of the liquid crystal molecules. Parallel polarizers (not shown) are provided at either side of the cell 2. The relative orientation of the polarizers determines whether or not light can pass through a pixel in a given state. Accordingly, for a given orientation of the polarizers, each pixel has a first and a second optically distinguishable state provided by the two bistable states of the liquid crystal molecules in that pixel.

Voltage waveforms are applied to the row electrodes 6 and column electrodes 8 respectively by row drivers 10 and column drivers 12. The matrix of pixels 4 is addressed on a line-by-line basis by applying voltage waveforms, termed strobe waveforms, serially to the row electrodes 6 while voltage waveforms, termed data waveforms, are applied in parallel to the column electrodes 8. The resultant waveform across a pixel defined by a row electrode and a column electrode is given by the potential difference between the waveform applied to that row electrode and the waveform applied to that column electrode.

Figure 2:
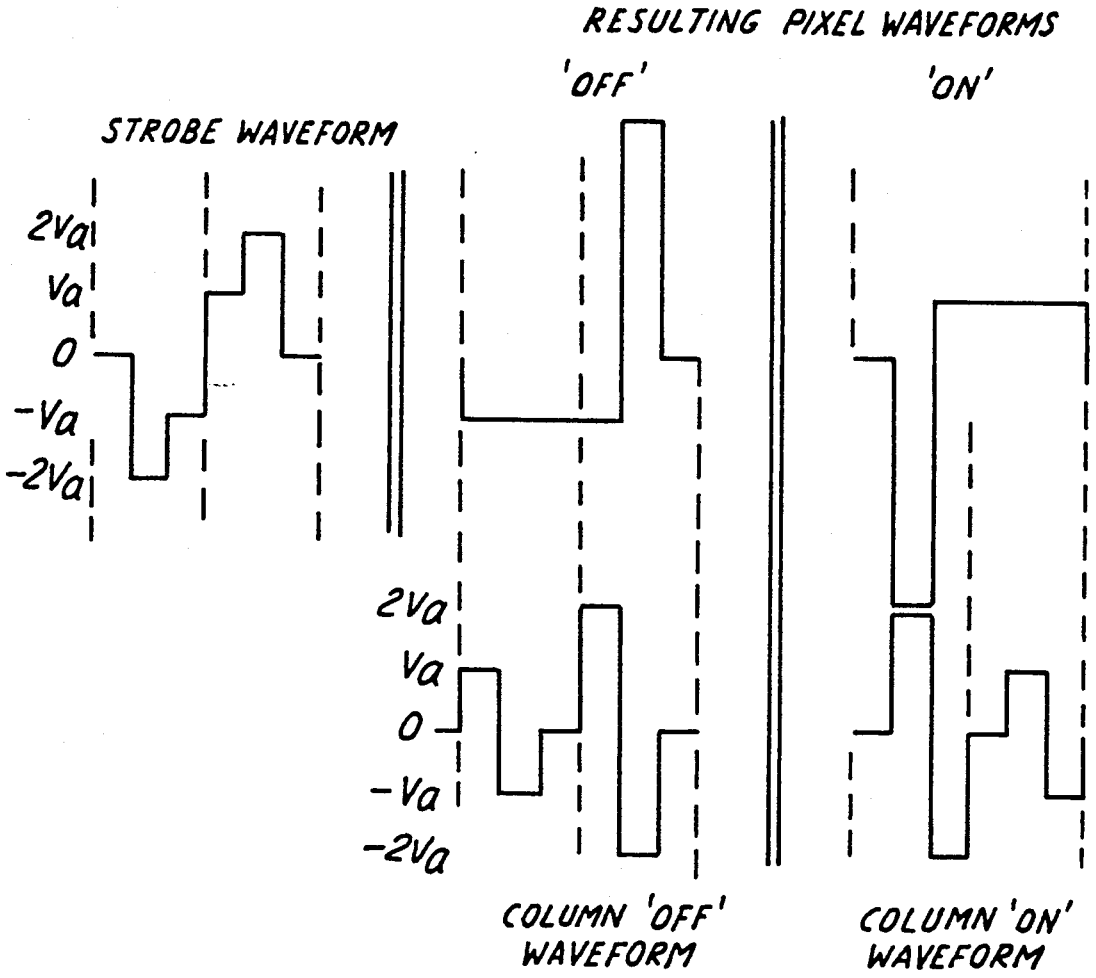
FIGS. 2 to 5 show waveform arrangements in accordance with the method of the present invention.

FIG. 2 shows an arrangement embodying the present invention. The arrangement utilizes a 1.5 slot in the sense of a slot being the minimum time that the material takes to switch, i.e. $1.5t_5$. The driver output voltages have to change 6 times and 5 output states are required. The top left hand strobe waveform appears on the selected row. Unselected i.e. unstrobed rows have a constant 0 volts applied. The second row on the diagram shows the column or data waveforms. These have been arranged to consist of bipolar pulses to minimize their switching effect on unselected rows. The resultant pixel waveforms for a selected row are shown above the respective column waveforms. A pixel being switched off, receives a long low voltage negative pulse followed by a short high voltage positive one of equivalent area maintaining zero D. C. content. A pixel being switched on receives a short high voltage negative equalising pulse followed by a long low voltage positive switching pulse. Related schemes are shown in FIGS. 3, 4 and 5 giving alternative equalisation pulse shapes.

Each of the arrangements shown in FIGS. 2 to 5 uses the fact that a switching pulse having a sufficient pulse width and pulse height magnitude to switch a pixel can be charge-balanced by a non-switching pulse of less pulse width, i.e. insufficient to switch the pixel, but of greater pulse height magnitude. In each arrangement, one of two waveforms—a bipolar strobe waveform or a constant zero-voltage waveform—can be applied to each row electrode, the row electrode to which the strobe waveform is applied being the selected row. One of two data waveforms—a column 'off' waveform or a column 'on' waveform—can be applied to each column electrode. As both the data waveforms are bipolar waveforms, the resulting pixel waveforms on unstrobed rows have no net effect on the pixels of those rows and so the pixels do not switch states. On the selected row, the combination of the bipolar strobe waveform and either one of the data waveforms produces a resulting pixel waveform which is a switching pixel waveform. Such a waveform, as shown in FIGS. 2 to 5, consists of a first pulse, i.e. the switching pulse, having a sufficient pulse width and pulse height magnitude to switch the selected pixel, a second pulse charge-balancing the first pulse, having a pulse height magnitude greater than the sufficient pulse height magnitude of the switching pulse and a pulse width insufficient to switch back the selected pixel; and optionally a zero voltage signal having no effect on the charge-balancing. The arrangement of FIG. 5 differs from the arrangements of FIGS. 2 to 4 in that in the switching pulse itself can be distinguished two pulses, one of which has a smaller pulse height magnitude than the other, the width of the total pulse being sufficient to switch a selected pixel at the smaller pulse height magnitude.

Figure 4:
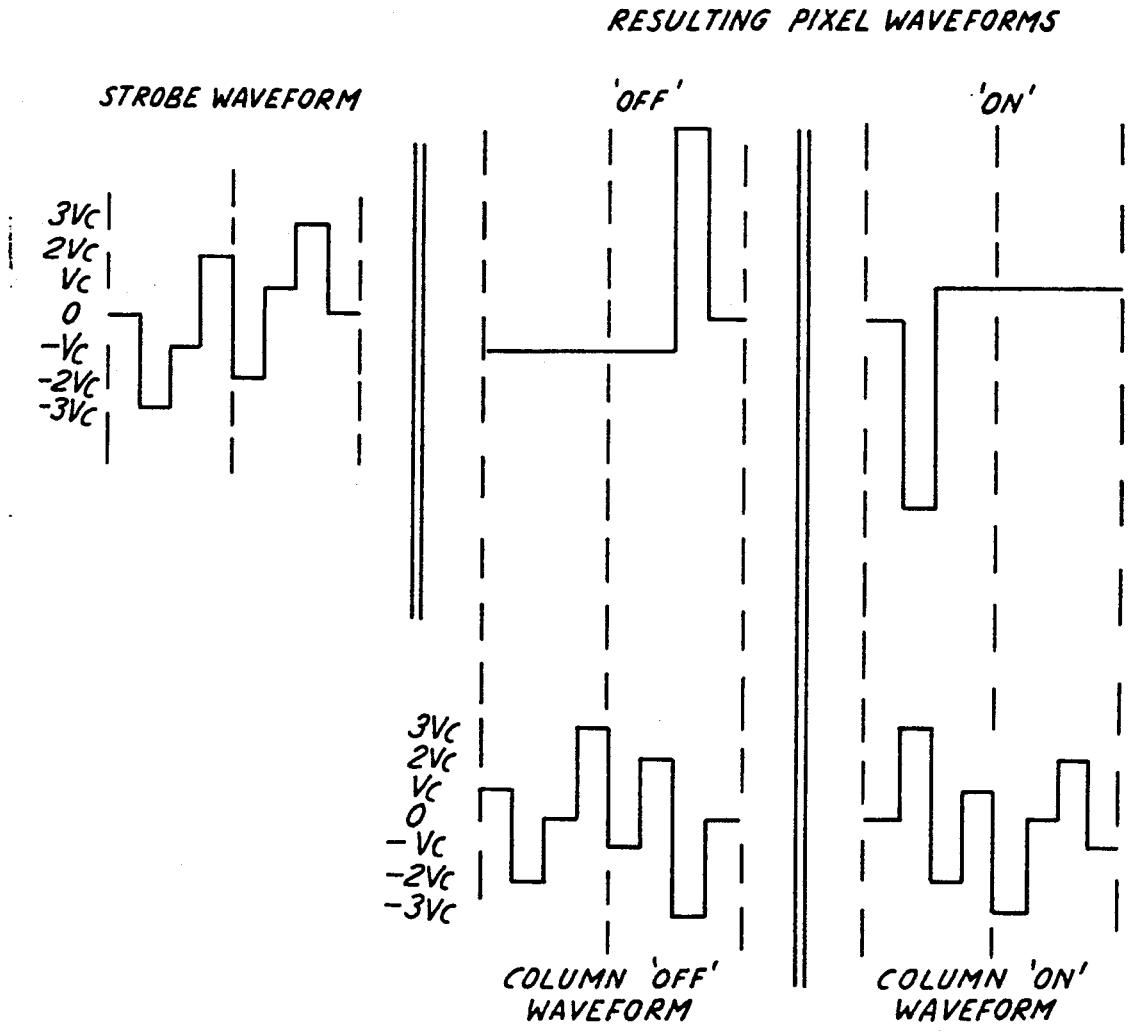
Figure 5:
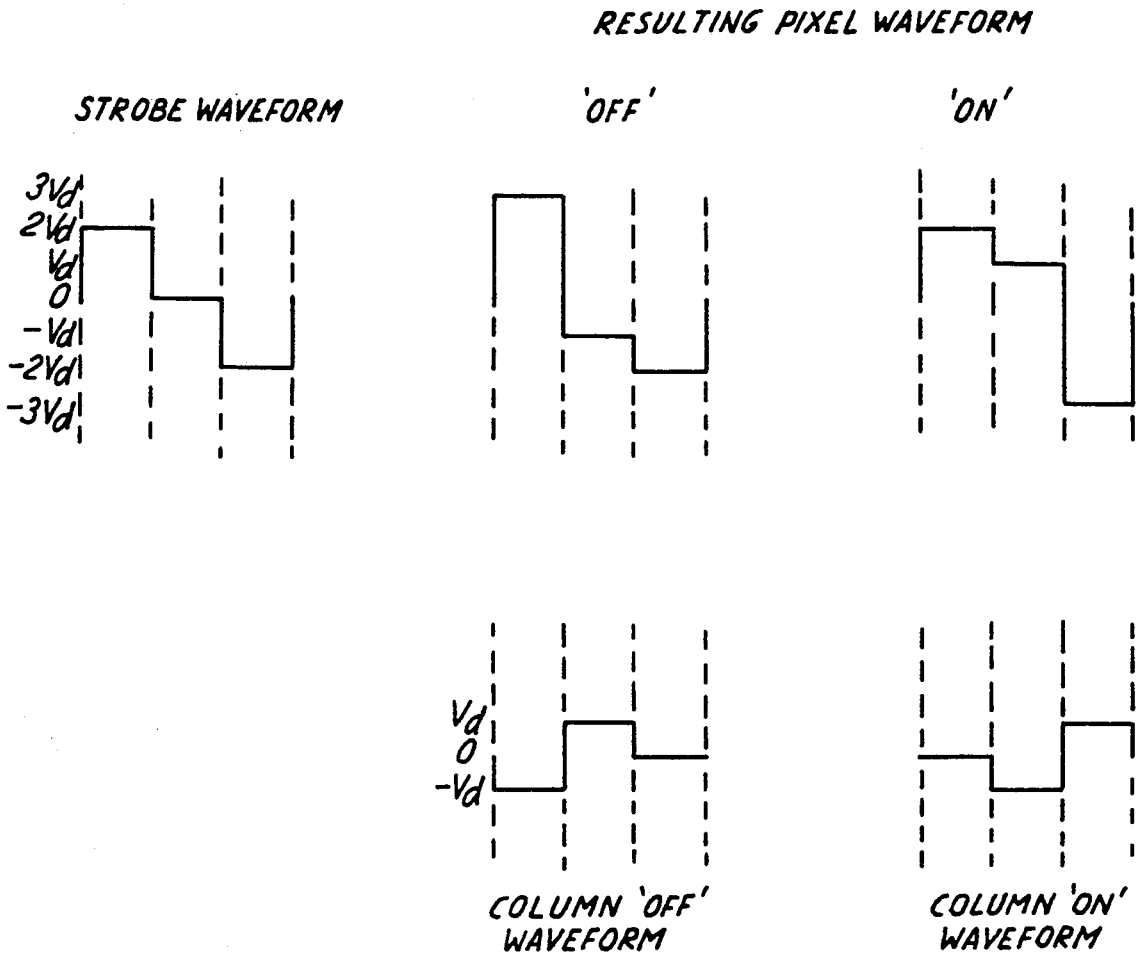

As can also be seen from FIGS. 2 to 5, the minimum line address time of each arrangement is less than twice the response time $t_5$ of the liquid crystal material at the pulse height of the switching pulse. In FIGS. 2, 3, and 5 the line address time is $1.5t_5$, and in FIG. 4, the line address time is $1.3t_5$. The line address time of the arrangement of FIG. 4 is less than that of the arrangements of FIGS. 2, 3 and 5 but at the expense of requiring more output states.

Figure 6:
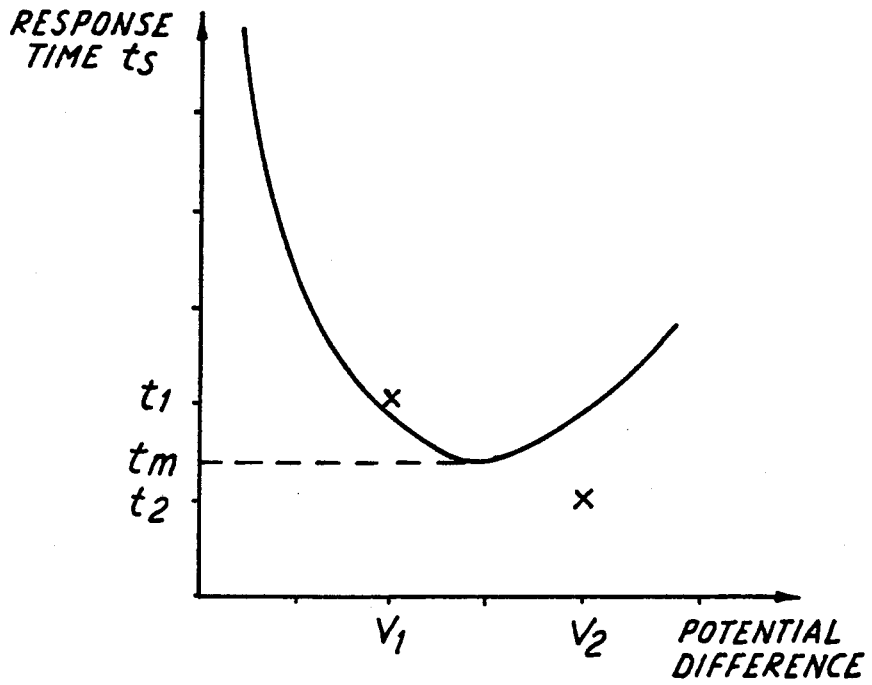
FIGS. 6 and 7 show electro-optic characteristics for liquid crystal materials which can be incorporated in the display device of FIG. 1.

FIG. 6 shows the electro-optic characteristic of a ferroelectric liquid crystal material, such as the aforementioned biphenyl ester, which is suitable for use in a matrix-array type liquid crystal cell addressed by the method of the present invention. An electro-optic characteristic is a graph showing response time of a liquid crystal material against potential difference across the material. As there is a minimum in the characteristic, pulses of a width less than $t_m$ will not switch the pixel irrespective of the height of the pulse. Accordingly, as can be seen from FIG. 5, a switching pulse of height $V_1$ and width $t_1$, can be charge balanced by a pulse of height $V_2$ greater than $V_1$ and width $t_2$, which width $t_2$ less than $t_m$ is a width insufficient to switch a pixel irrespective of the pulse height.

Figure 7:
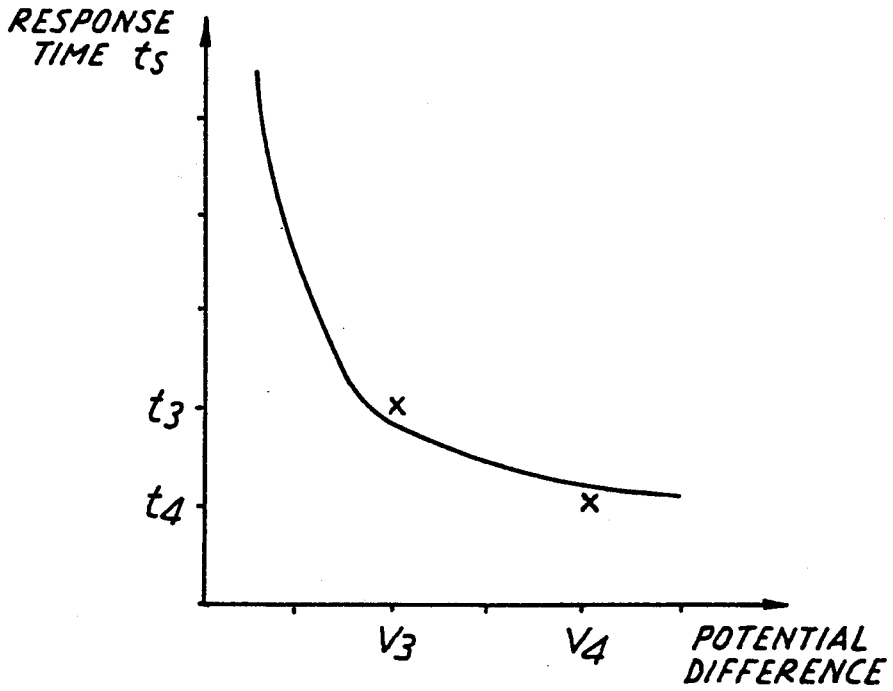

It is also envisaged that the method of the present invention can be used to address a matrix-array type liquid crystal cell with a liquid crystal material, such as a flouro-terphenyl, having an electro-optic characteristic as shown in FIG. 7, in which the response time $t_5$ decreases asymptotically with potential difference. In this case, a switching pulse of height $V_3$ and width $t_3$ is charge balanced by a pulse of height $V_4$ greater than $V_3$ and width $t_4$, which width $t_4$ is insufficient in relation to the height $V_4$ to switch the selected pixel. Thus, there is an element of switching by pulse height as well as by pulse width. Both pulse width and pulse height would also have to be considered in the case where the electro-optic characteristic does have a minimum but the pulse height and width of the switching pulse are such that charge-balancing can be provided by a pulse of width greater than $t_m$.

The relatively complex waveforms of FIGS. 2 to 5 need not be generated independently at each row or column driver. In each case the row or column output stage need only switch between one of the two waveforms.

Figure 8:
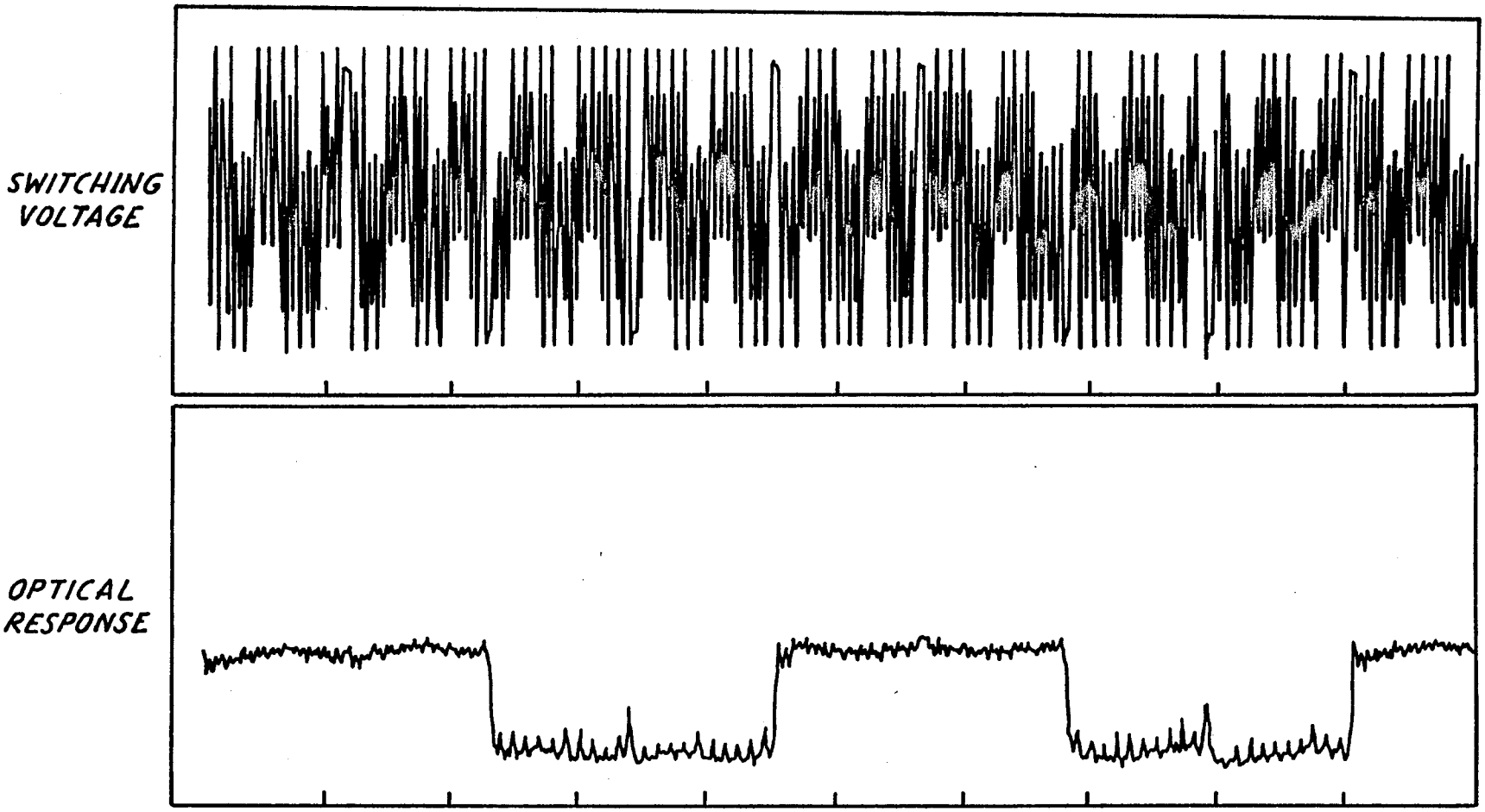
FIGS. 8 and 9 show, to different time scales, the switching voltage and resulting optical response of a pixel in the display device of FIG. 1.
Figure 9:
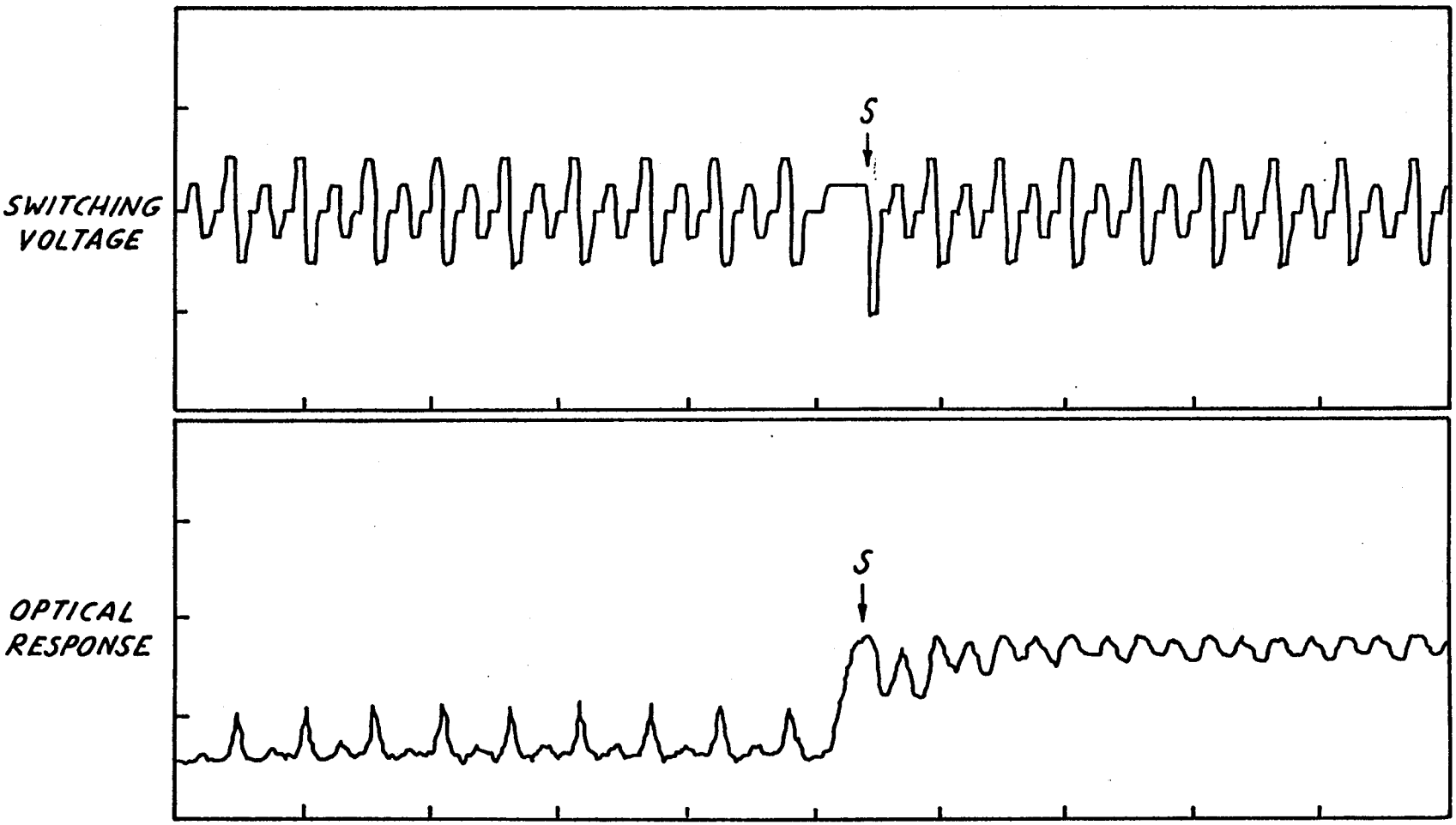

FIGS. 8 and 9 show an oscilloscope trace of the switching voltage, i.e. resulting pixel waveform, and optical response resulting from a simulation of the proposed scheme. FIG. 8 shows that the liquid crystal is switching between the two optically distinguishable states and remaining stable while the row is not being selected; the switching waveform is too fast for the oscilloscope sampling. FIG. 9 shows in more detail the switching point 8. Switching occurs when the wide pulse is applied. The narrower equalisation and cross-talk pulses serve to stabilise the pixel state.

As disclosed in our co-pending European Patent Application also claiming priority from GB 8717172 and GB 8718351 readily-available integrated circuits can be issued to implement efficiently complicated X-Y matrix display drive schemes for two level displays, particularly, the relatively complex waveforms used in the method of the present invention.

Display driver chips are available which have multiple high voltage CMOS outputs and take the form of n stage shift registers with latched outputs. These chips were originally designed for use with ACEL displays but they are now being used in a number of LCD implementations. An apparent limitation of these devices is that the outputs are two state. The output voltage is either at the high voltage or at ground. This limitation is removed by using the proposed arrangement and method.

Figure 10:
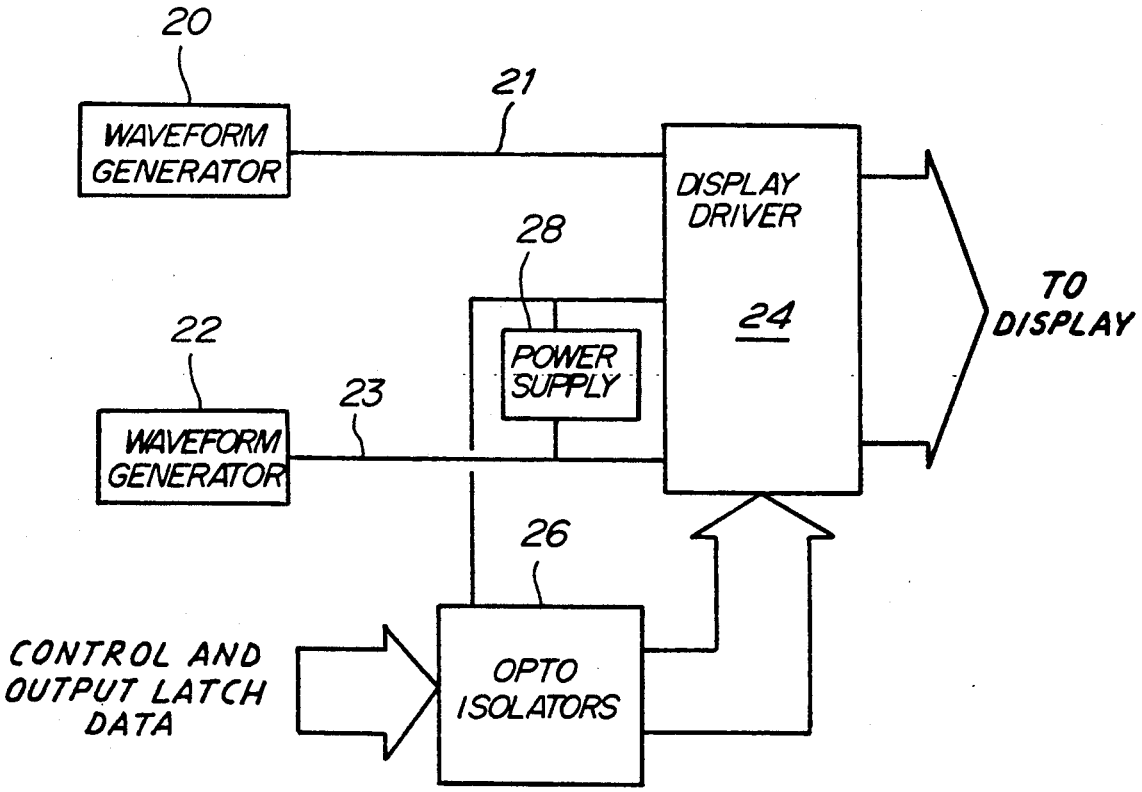
FIG. 10 shows schematically a drive circuit for the display device of FIG. 1.

FIG. 10 shows a block diagram representing this arrangement and method. The drive circuit comprises means 20 to generate a first waveform A at a first supply rail 21 and means 22 to generate a second waveform B at a second supply rail 23 which acts as ground potential for the circuit. A display driver chip 24 has a plurality of outputs, each including a switch for switching the output either to waveform A at the first supply rail 21 or to waveform B at the second supply rail 23. Accordingly a respective output waveform is produced at each of the plurality of outputs.

The selective switching of each output to either waveform A or to waveform B is controlled by control and output latch data from a control circuit (not shown). As the ground potential of the drive circuit as a whole is varying with the voltage of waveform B, the data is fed to the driver chip 24 via means to isolate the data waveforms so that these will be relative to the supply rail 23, such as opto-isolators 26. If the logic for an output is '1' then the output is switched to waveform A at supply rail 23, if the logic is '0' then the output is switched to waveform B at supply rail 23. The power supply to the driver chip 24 comprises an isolated power supply 28 to provide a constant 12 V potential difference with respect to the potential of the ground supply rail 23.

Figure 11:
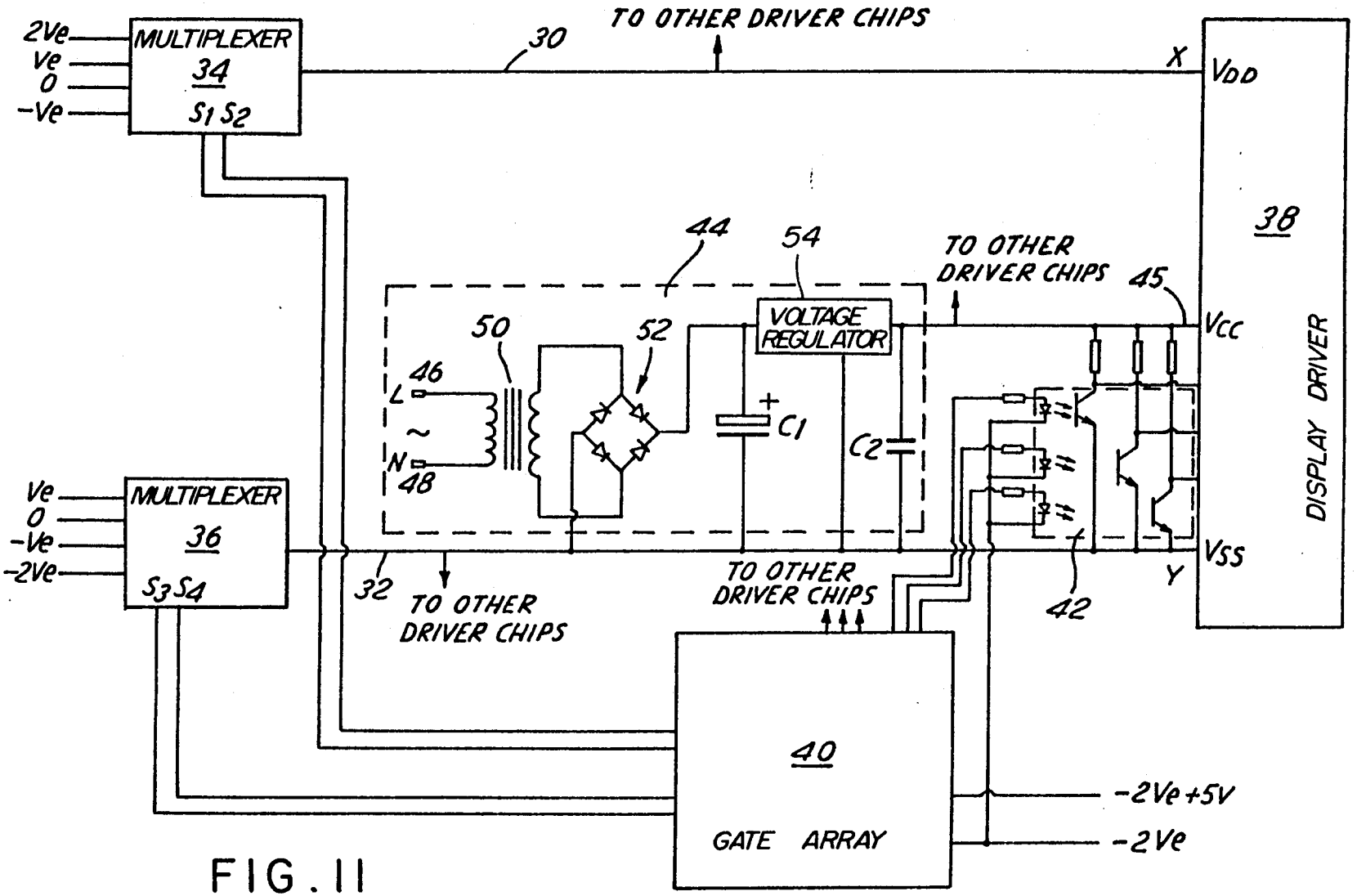
FIG. 11 shows a drive circuit for the display device of FIG. 1.

A specific embodiment of a drive circuit is shown in FIG. 11. Waveforms X and Y at supply rails 30 and 32 are generated by first and second 4-way high voltage multiplexers 34, 36. Each multiplexer 34, 36 is capable of generating four voltage states, e.g. states 2 $V_e$, $V_e$, O and $-V_e$ for multiplexer 34 and states $V_e$ O, $-V_e$ and $-2$ $V_e$ for multiplexer 36, to produce the respective waveform, the voltage state generated at any particular instant being one of the four states and determined by logic inputs $S_1$, $S_2$ to multiplexer 34 and logic inputs $S_3$, $S_4$ to multiplexer 36, as shown below:

| Multiplexer 34 | | | Multiplexer 36 | | |
|---|---|---|---|---|---|
| $S_1$ | $S_2$ | Output (X) | $S_3$ | $S_4$ | Output (Y) |
| 0 | 0 | $-V_e$ | 0 | 0 | $-2V_e$ |
| 0 | 1 | 0 | 0 | 1 | $-V_e$ |
| 1 | 0 | $V_e$ | 1 | 0 | 0 |
| 1 | 1 | $2V_e$ | 1 | 1 | $V_e$ |

For the aforementioned biphenyl ester, $V_e=35$ V can be used.

The display driver chip 38 of the circuit is an Si 9555 (manufactured under the trade mark 'Siliconix') having 32 channels, i.e. a 32 bit stage shift register, 32 latches and 32 outputs. Each one of the outputs is switched to either the voltage of supply rail 30 (i.e. waveform X) by a logic input of '1' or to the voltage of supply rail 32 (i.e. waveform Y) by a logic input of '0'.

The logic to control the multiplexers 34, 36 and the driver chip 38 is generated and synchronised by a gate array 40. FIG. 11 shows three outputs from the gate array 40 connected to respective three inputs of the driver chip 38 via three opto-isolators (designated generally by the reference 42). The three inputs shown comprise a clock input and a data input which load logic serially into the 32-bit stage shift register, and a latch enable which, when high, shifts the contacts of the 32 bit stage shift register into an output register, in known manner. Power is supplied to the gate array 40 itself by two supply rails at $-2$ $V_e$ and $-2$ $V_e+5$ V.

The driver chip 38 is powered by a 12 V constant DC supply produced by an isolated power supply 44 connected across a positive power supply rail 45 and the ground supply rail 32. Inputs 46, 48 to the power supply 44 are connected to a 240 V AC mains supply. The voltage is transformed down at a transformer 50 and rectified at a full wave rectifier 52. The power supply 44 further comprises a 10,000 μF electrolytic capacitor $C_1$, a 7812 voltage regulator 54 and a 100 nF capacitor $C_2$. The 12 V constant DC supply produced is constant with respect to the ground supply rail 32 and accordingly the positive power supply rail 45 has superimposed thereon the voltage of waveform Y.

A typical display device has of the order of several hundred row and column electrodes and accordingly a large number of driver chips are required. However a single multiplexer 34, multiplexer 36, isolated power supply 44 and gate array 40 can be provided for a set of row or column electrodes and corresponding driver chips.

Accordingly, rather than being used as a two state driver the chip is effectively being used as a set of analogue switches. The latches and the shift register are powered separately to the high voltage output stage so their operation is not affected, provided the power is maintained with respect to the ground (waveform B). Any of the outputs can be switched to either waveform A or waveform B. The only limitation is that the instantaneous voltage of waveform A must never be less than that of waveform B by more than two diode forward voltage drops. If the two alternative row or column drive waveform cross then the contents of the output latches can be inverted and the waveforms interchanged.

FIGS. 12*a* to 12*h* show how this method and arrangement can be used to implement the arrangement of FIG. 3. The left hand column shows the waveforms for a drive circuit for the row electrodes and the right hand column shows the waveforms for a drive circuit for the column electrodes. FIGS. 12*a* and 12*b* show the waveforms A and B applied to the supply rails of the row drive circuit. As can be seen, the strobed waveform (FIG. 12*c*) is produced by a data sequence of 000111 and the unstrobed waveform (FIG. 12*d*) by a data sequence of 111000. FIGS. 12*e* and 12*f* show the waveforms A and B applied to the supply rails of the column drive circuit. The column 'on' waveform (FIG. 12*g*) is produced by a data sequence of 110011 and the column 'off' waveform (FIG. 12*h*) by a data sequence of 001100.

Similar waveforms A and B can be devised for the arrangements of FIGS. 2, 4 and 5.

We claim:

1. A method of addressing a matrix-array type liquid crystal cell with a ferroelectric liquid crystal layer having a plurality of pixels defined by areas of overlap between members of a first set of electrodes on one side of the liquid crystal layer and members of a second set of electrodes on the other side of the liquid crystal layer, each of said pixels having a first and a second optically distinguishable state, and having a response time for switching between said first and said second states which depends on the potential difference across the liquid crystal layer, the method including the step of applying a switching pixel waveform to a selected pixel to switch said selected pixel between said first and second states wherein said switching pixel waveform is charge-balanced and comprises a switching pulse having a pulse width and pulse height magnitude which, in combination, switch said selected pixel and another pulse, contributing to charge balancing, having a pulse height magnitude greater than the pulse height magnitude of said switching pulse and a pulse width which is less than that of the switching pulse and which, in combination with the pulse height magnitude thereof, is insufficient to switch said selected pixel, thereby to enable charge balanced addressing of said pixel with a waveform having a duration less than twice that of the switching pulse.

2. A method according to claim 1 wherein said switching pixel waveform consists of the switching pulse, said another pulse and optionally one or more zero voltage signals, said another pulse charge balancing said switching pulse.

3. A method according to claim 1, the cell being addressed on a line-by-line basis by applying strobe waveforms serially to members of said first set of electrodes while data waveforms are applied in parallel to members of said second set of electrodes wherein said data waveforms comprise balanced bipolar pulses.

4. A method according to claim 3 wherein said strobe waveforms comprise balanced bipolar pulses.

5. A method according to claim 1 wherein the response time of the liquid crystal layer shows a minimum at a particular potential difference and the pulse width of said another pulse is insufficient to switch said selected pixel irrespective of the pulse height of said another pulse.

6. A method according to claim 1 wherein the width of said another pulse is insufficient in relation to the pulse height of said another pulse to switch said selected pixel.

7. A drive circuit for addressing a matrix-array type liquid crystal cell having a plurality of pixels defined by areas of overlap between members of a first set of electrodes on one side of a liquid crystal layer and members of a second set of electrodes on the other side of the liquid crystal layer, each of said pixels having a first and a second optically distinguishable state, and having a response time for switching between said first and said second states which depends on the potential difference across the liquid crystal layer, the drive circuit being arranged to provide a charge balanced switching pixel waveform for switching a selected pixel between said first and second states, the waveform comprising a switching pulse having a pulse width and pulse height which in combination enables switching of a pixel and another pulse, contributing to charge balancing, having a pulse height magnitude greater than the pulse height magnitude of the switching pulse and a pulse width less than that of the switching pulse and which, in combination with the pulse height magnitude thereof, is insufficient to switch the pixel, whereby the switching pixel waveform is arranged for enabling charge balanced addressing of said pixel and has a duration less than twice that of the switching pulse.

8. A drive circuit according to claim 7 wherein the switching pixel waveform consists of the switching pulse, said another pulse and optionally one or more zero voltage signals, said another pulse charge balancing said switching pulse.

9. A drive circuit according to claim 7 arranged to supply strobe waveforms serially for application to members of said first set of electrodes and simultaneously to supply data waveforms in parallel for application to members of said second set of electrodes, the data waveforms comprising balanced bipolar pulses, thereby to provide the switching pixel waveform for addressing the cell on a line-by-line basis.

10. A drive circuit according to claim 9 wherein the strobe waveforms comprise balanced bipolar pulses.

11. A drive circuit according to claim 7 wherein the response time of the liquid crystal layer of the cell to be addressed by the drive circuit exhibits a minimum at a particular potential difference, the pulse width of said another pulse provided by the drive circuit being arranged such that it is insufficient to switch a pixel of the liquid crystal layer irrespective of the pulse height of said another pulse.

12. A drive circuit according to claim 7 wherein the pulse width of said another pulse is insufficient in relation to the pulse height of said another pulse to switch said selected pixel.

13. A display device comprising a matrix-array type liquid crystal cell with a ferroelectric liquid crystal layer, a first set of electrodes and a second set of electrodes, areas of overlap between members of said first set and members of said second set defining a plurality of pixels in the liquid crystal layer, each of said pixels having a first and a second optically distinguishable state and having a response time for switching between said first and said second states which depends on the potential difference across the liquid crystal layer, the display device further comprising a drive circuit arranged to provide a charge balanced switching pixel waveform via the first and second sets of electrodes for switching a selected pixel between said first and said second states, the waveform comprising a switching pulse having a pulse width and pulse height which in combination enables switching of the pixel and another pulse, contributing to charge balancing, having a pulse height magnitude greater than the pulse height magnitude of the switching pulse and a pulse width less than that of the switching pulse and which, in combination with the pulse height magnitude thereof, is insufficient to switch the pixel, thereby to enable charge balanced addressing of said pixel with a waveform having a duration less that twice that of the switching pulse.

14. A display device according to claim 13 wherein the switching pixel waveform consists of the switching pulse, said another pulse and optionally one or more zero voltage signals, said another pulse charge balancing said switching pulse.

15. A display device according to claim 13 wherein the cell is addressed on a line by line basis, the drive circuit being arranged to provide strobe waveforms serially to members of said first set of electrodes while data waveforms are applied in parallel to members of said second set of electrodes, and wherein said data waveforms comprise balanced bipolar pulses.

16. A display device according to claim 15 wherein said strobe waveforms comprise balanced bipolar pulses.

17. A display device according to claim 13 wherein the response time of the liquid crystal layer exhibits a minimum at a particular potential difference and the pulse width of said another pulse is insufficient to switch said selected pixel irrespective of the pulse height of said another pulse.

18. A display device according to claim 13 wherein the pulse width of said another pulse is insufficient in relation to the pulse height of said another pulse to switch said selected pixel.

* * * * *